US006931662B2

(12) United States Patent
Lindemulder

(10) Patent No.: US 6,931,662 B2
(45) Date of Patent: Aug. 23, 2005

(54) BALLISTIC VEST

(75) Inventor: Jan L. Lindemulder, Maastricht (NL)

(73) Assignee: DSM IP Assets B.V., Heerlen (NL)

( * ) Notice: Subject to any disclaimer, the term of this patent is extended or adjusted under 35 U.S.C. 154(b) by 87 days.

(21) Appl. No.: 10/221,222

(22) PCT Filed: Mar. 9, 2001

(86) PCT No.: PCT/NL01/00198

§ 371 (c)(1),
(2), (4) Date: Dec. 30, 2002

(87) PCT Pub. No.: WO01/67027

PCT Pub. Date: Sep. 13, 2001

(65) Prior Publication Data

US 2003/0106126 A1 Jun. 12, 2003

(30) Foreign Application Priority Data

Mar. 10, 2000 (NL) ..... 1014608

(51) Int. Cl.[7] ..... F41H 1/02
(52) U.S. Cl. ..... 2/2.5
(58) Field of Search ..... 2/2.5, 455, 456, 2/463, 467, 464, 465; 89/36.02, 36.05; 428/340, 911, 912; 442/246, 286, 297, 390, 298, 255, 269, 301, 333, 366, 206, 207, 208, 239

(56) References Cited

U.S. PATENT DOCUMENTS 3,974,313 A * 8/1976 James ..... 428/176
6,266,819 B1 * 7/2001 Bachner, Jr. ..... 2/2.5
6,526,862 B1 3/2003 Lyons

FOREIGN PATENT DOCUMENTS

WO 87/03674 6/1987

OTHER PUBLICATIONS

Technical Information for ZYLON (PBO fiber); 3 pages.

* cited by examiner

*Primary Examiner*—Gary L. Welch
(74) *Attorney, Agent, or Firm*—Mayer, Brown, Rowe & Maw LLP

(57) ABSTRACT

The invention relates to a ballistic vest which offers a ballistic resistance meeting NIJ2 Standard 0101.03 and comprises a stack of flexible unidirectional layers in which the unidirectional layers contain strong fibers and in which the fibers in a unidirectional layer run substantially parallel and are positioned at an angle of more than 0 degrees relative to fibers in an adjacent layer, said fibres being PBO fibres.

4 Claims, No Drawings

BALLISTIC VEST

CROSS REFERENCE TO RELATED APPLICATIONS

This application is a National Phase application of International Application No. PCT/NL01/00198, filed Mar. 9, 2001, and which further claims priority from Dutch Application No. 1014608, filed Mar. 10, 2000. These applications, in their entirety, are incorporated herein by reference.

The invention relates to a ballistic vest which offers a ballistic resistance meeting NIJ2 Standard 0101.03 and comprises a stack of flexible unidirectional layers (UD-layers) in which the unidirectional layers contain strong fibres and in which the fibres in a unidirectional layer run substantially parallel and are positioned at an angle of more than 0 degrees relative to fibres in an adjacent layer.

Such a vest is known from U.S. Pat. No. 5,926,842.

U.S. Pat. No. 5,926,842 describes a ballistic vest which offers a ballistic resistance meeting NIJ2 Standard 0101.03 and contains a stack of flexible unidirectional layers in which the unidirectional layers contain aramid fibres and in which the fibres in a unidirectional layer run substantially parallel and are positioned at an angle of 90 degrees relative to fibres in an adjacent layer.

The drawback of such a vest is its relatively high weight. The weight of a vest is indicated as the areal density, which is the weight of the stack of flexible layers that are needed in order to meet NIJ2 Standard 0101.03 per unit of surface. The vests described in U.S. Pat. No. 5,926,842 require an areal density of 3.7 kg/m$^2$ in order to meet the NIJ2 Standard.

The aim of the invention is to provide a vest of a much lower areal density.

This aim is achieved due to the strongfibres being poly (p-phenylene-2,6, -benzobisoxazole) (PBO) fibres.

With an areal density of 2.8 kg/m$^2$ the vest according to the invention already meets NIJ2 Standard 0101.03.

An advantage of the vest according to the invention is that it is more comfortable to wear owing to its lower weight.

The ballistic resistance of a vest can be classified according to different standards. One of those standards is NIJ Standard 0101.03, which defines different levels of protection. Thus, the NIJ2 Standard requires a vest to be able to stop a .357 Magnum JSP as well as a 9 mm FMJ having a velocity of 426±15 m/s.

In addition to non-penetration of a projectile the degree of body deformation at the impact spot is a second requirement defined in NIJ Standard 0101.03. This deformation is an indication of the projectile impact trauma suffered by the wearer of a vest. In the NIJ2 Standard it is specified that the trauma should be less than 44 mm.

By a ballistic vest offering a ballistic resistance in accordance with NIJ2 Standard 0101.03 is understood here and in the following a vest having such an areal density that the above-mentioned standard is just complied with. By 'just' is understood that the areal density is not higher than the value which is required to prevent projectile penetrations and a trauma bigger than 44 mm at the upper limit of the NIJ2 Standard, i.e. at a bullet velocity of 441 m/s, while at a higher velocity projectile penetration or a trauma bigger than 44 mm or a combination of these may occur.

The stack of UD layers can consist of one or more UD packs. The stack of UD layers preferably consists of several UD packs, each of which contains two or four UD layers.

The packs are preferably provided with a smooth film on either side, reducing the friction between the packs and enhancing the flexibility of the stack.

By 'fibres' in this context are understood objects having a length that is much larger than its width and thickness. Fibres comprise continuous mono- and multifilaments as well as discontinuous filaments such as staple fibres or cut fibres.

"Strong fibres" are in this invention fibres having a strength of at least 6 dN/tex, a modulus of at least 130 dN/tex and an energy absorbed during fracture of at least 8 J/g. Strong fibres are preferably fibres having a strength of at least 10 dN/tex, a modulus of at least 200 dN/tex and an energy absorbed during fracture of at least 20 J/g. More preferable are fibres having a strength of at least 16 dN/tex, a modulus of at least 400 dN/tex and an energy absorbed during fracture of at least 27 J/g.

The invention also relates to a ballistic vest according to claim 1, with an areal density of less than 2.8 kg/m$^2$.

The invention will now be elucidated by means of a few examples.

By the 'areal density' (AD) of a fabric or UD layer or pack is understood the fabric or UD layer weight per surface unit.

The PBO fibre used in the experiments was a Zylon® fibre from Toyobo, having a titre of 1100 dTex. There are two versions of Zylon: HM (high modulus) and AS (as spun), the characteristics of which, as specified by Toyobo, are given in Table 1:

TABLE 1

| Type | Tensile modulus (cN/dTex) |
|---|---|
| Zylon AS | 1192 |
| Zylon HM | 1678 |

preferably an as-spun grade of PBO is used. In spite of the fact that the modulus of Zylon AS is much lower than that of Zylon HM, AS gives better ballistic properties than HM.

Zylon UD is a pack of two layers laid crosswise in which the fibres in each layer run virtually parallel and are positioned normal to the fibres in an adjacent layer, each layer being made of 1100 dTex Zylon yarns. The yarn weight per layer amounts to 36 g/m$^2$. The Zylon UD pack comprises a matrix comprising a styrene-isoprene-styrene block copolymer and is on both sides covered with a polyethylene (PE) film of 7 g/m$^2$. A Zylon UD pack has an areal density of 100 g/m$^2$. The matrix content amounts to 17 wt. % relative to the total of matrix and fibre weight.

Dyneema UD-SB2 is a pack of four layers laid crosswise in which the fibres in each layer run virtually parallel and are positioned normal to the fibres in an adjacent layer, each layer being made of highly drawn polyethene (HPPE) yarns. The weight per layer amounts to 33 g/m$^2$. The UD-SB2 pack comprises a rubber matrix and is on both sides covered with a PE film. A UD-SB2 pack has an AD of 155 g/m$^2$.

Dyneema UD-SB31 is a pack of two layers laid crosswise in which the fibres in each layer run virtually parallel and are positioned normal to the fibres in an adjacent layer, each layer being made of HPPE yams. The weight per layer amounts to 59 g/m$^2$. The UD-SB31 pack comprises a rubber matrix and is on both sides covered with a PE film. A UD-SB31 pack has an AD of 132 g/m$^2$.

EXAMPLE 1

Vests of stacks of a varying number of Zylon-UD packs were fired at with a 0.375 Magnum JSP bullet with a velocity of 426±15 m/s. At the back of each stack a Roma plastiline No. 1 pack had been affixed, conditioned in accordance with the NIJ 0101.03 Standard. In all experiments the bullet was stopped. The trauma was measured. The results are presented in Table 2.

TABLE 2

| Number of packs | Areal density (kg/m$^2$) | Velocity (m/s) | Trauma (mm) |
|---|---|---|---|
| 38 | 3.84 | 409 | 30 |
| 38 | 3.84 | 416 | 28 |
| 38 | 3.84 | 452 | 26 |
| 34 | 3.43 | 447 | 29 |
| 34 | 3.43 | 457 | 30 |
| 32 | 3.23 | 435 | 39 |
| 32 | 3.23 | 442 | 38 |
| 29 | 2.93 | 443 | 38 |
| 27 | 2.73 | 444 | 41 |
| 27 | 2.73 | 442 | 39 |

Comparative Experiment A

Vests of stacks of 29 UD-SB31 packs with a total areal density of 3.8 kg/m$^2$ were fired at with a 0.375 Magnum JSP bullet with a velocity of 435±5 m/s. All bullets were stopped and the average trauma was 39 mm.

With a vest made of a stack of 25 UD-SB2 packs, having an areal density of 3.3 kg/m$^2$, bullets went through.

This shows that with a weight of more than 1 kg less than that of a HPPE vest based on Dyneema UD-SB31 a PBO vest can meet the NIJ2 requirement.

Comparative Experiment B

Vests of stacks of 29 UD-SB2 packs with an areal density of 4.9 kg/m$^2$ were fired at with a 0.375 Magnum JSP bullet with a velocity of 435±5 m/s. All bullets were stopped and the average trauma was 35 mm.

With a vest made of a stack of 23UD-SB2 packs, having an areal density of 3.6 kg/m$^2$, bullets went through.

This shows that with a weight of more than 1.7 kg less than that of a HPPE vest based on Dyneema UD-SB2 a PBO vest can meet the NIJ2 requirement.

What is surprising is that WO9749546 does not teach that PBO is better than aramid, that PBO in general even is not better than PE, but that PBO is surprisingly good in the light of NIJ2.

Comparative Experiment C

Example 1 and Comparative Experiments A and B were repeated with a heavier stack and the vests were tested with a Magnum 0.44 bullet in accordance with the NIJ3a Standard.

The numbers of packs required in order to just meet the NIJ3a Standard are stated in Table 3.

TABLE 3

| Material | Number of packs | Areal density (kg/m$^2$) |
|---|---|---|
| Zylon-UD | 46 | 4.7 |
| SB31 | 34 | 4.5 |
| SB2 | 34 | 5.3 |

This shows that in the case of a vest which is subject to the NIJ3a Standard, PBO does not offer special advantages compared with HPPE fibre.

What is claimed is:

1. Ballistic vest having a ballistic resistance meeting NIJ2 Standard 0101.03 and comprising a stack of flexible unidirectional layers in which the unidirectional layers contain strong fibres and in which the fibres in a unidirectional layer run substantially parallel and are positioned at an angle of more than 0 degrees relative to fibres in an adjacent layer, wherein the fibres are PBO fibres, and further wherein the areal density is less than 3.23 kg/m$^2$.

2. Ballistic vest according to claim 1, wherein the areal density is less than 2.8 kg/m$^2$.

3. Ballistic vest according to claim 1, wherein the PBO is an as-spun grade, with Tensile modulus below 1200 cN/dTex.

4. Ballistic vest according to claim 2, wherein the PBO is an as-spun grade, with Tensile modulus below 1200 cN/dTex.

* * * * *